United States Patent [19]

Unger

[11] Patent Number: 4,699,712

[45] Date of Patent: Oct. 13, 1987

[54] ORE DRESSING METHOD

[75] Inventor: Kim N. Unger, Tucson, Ariz.

[73] Assignee: Thiotech, Inc., Tucson, Ariz.

[21] Appl. No.: 834,144

[22] Filed: Feb. 25, 1986

Related U.S. Application Data

[63] Continuation-in-part of Ser. No. 622,473, Jun. 20, 1984, abandoned.

[51] Int. Cl.[4] ..... B03D 1/14

[52] U.S. Cl. ..... 209/166; 252/61

[58] Field of Search ..... 209/166; 252/61

[56] References Cited

U.S. PATENT DOCUMENTS

| | | | |
|---|---|---|---|
| 4,040,950 | 8/1977 | Zipperian et al. | 209/166 |
| 4,387,034 | 6/1983 | Unger et al. | 209/166 |
| 4,410,439 | 10/1983 | Cozier | 209/166 |

FOREIGN PATENT DOCUMENTS

| | | | |
|---|---|---|---|
| 159133 | 9/1954 | Australia | 209/167 |
| 500052 | 2/1954 | Canada | 209/166 |
| 2389414 | 12/1978 | France | 209/166 |
| 546232 | 7/1942 | United Kingdom | 209/166 |
| 2106804 | 4/1983 | United Kingdom | 209/166 |

*Primary Examiner*—Bernard Nozick

*Attorney, Agent, or Firm*—Harry M. Weiss & Associates

[57] ABSTRACT

An ore dressing method for beneficiating copper from copper bearing ore by froth flotation employing the collector which comprises a mixture of an O,O-bis(alkylphenyl) phosphorodithioic compound, e.g., sodium O,O-bis(isopropylphenyl) phosphorodithioate, and a thiono compound which is an alkyl xanthogen formate, e.g., isobutyl xanthogen alkyl ethyl formate, and/or a thionocarbamate, e.g., N-ethyl O-isopropyl dialkyl thionocarbamate.

20 Claims, No Drawings

ORE DRESSING METHOD

This application is a continuation-in-part of application Ser. No. 622,473, filed June 20, 1984, now abandoned.

BACKGROUND OF THE INVENTION

Field of the Invention

This invention relates generally to ore dressing method and to concentration of metal values in ores by flotation. More particularly, the invention provides a new and valuable method of recovering metal values from ores, whereby froth flotation of a slurry of the ore is conducted in the presence of a collector consisting essentially of a mixture of certain phosphorodithioic compounds with certain organic thiono compounds.

Flotation is a widely used method of concentrating ores, and it is believed to be the most commonly used ore dressing process. It is based on the fact that when air bubbles are introduced into a ground ore pulp, particles of some minerals will become attached to the bubbles, whereas other minerals will not become so attached and remain in the pulp. Certain chemicals facilitate flotation by conferring adherence and/or water-repellency to surfaces of minerals to be floated, and such chemicals have been generally called "promoters" or "collectors." Herein, they will be referred to as collectors.

Industrially, collectors for use in flotation are of great importance because even a very small improvement in the efficiency of the collector can have immense commercial effect. With the growing current practice of tailings retreatment, the cost efficiency of the collector becomes increasingly significant. Also of concern are possible toxicity and environmental applications as well as storage and handling.

SUMMARY OF THE INVENTION

Accordingly, an object of the invention is the provision of a flotation process wherein there is employed a collector which achieves improved recovery of metal values at nominal cost and without substantial detriment to health and environment.

Another object is the provision of a flotation method which will be useful with a great variety of sulfidic and non-sulfidic ores, including those of the precious metals. Still another object is the provision of a method which will be effective even under conditions where slime interference may present a problem. A most important object is the provision of an efficient flotation process for recovering copper values from copper-containing ores.

These and other objects hereinafter disclosed are provided by the invention wherein flotation of the ore is conducted in the presence of a collector comprising a synergistic mixture of (I) a phosphorodithioic compound of the formula $$-X-S-\underset{\underset{S}{\|}}{P}(OR)_2-$$

wherein X is selected from the class consisting of hydrogen, alkali metal and the ammonium radical and R is a alkyl-substituted phenyl radical having a total of from 8 to 14 carbon atoms, from 1 to 3 alkyl substituents, and from 1 to 6 carbon atoms in each alkyl substituent, and (II) a thiono compound selected from the class consisting of (A) alkyl xanthogen alkyl formates of the general formula $$Y-O-\overset{\overset{S}{\|}}{C}-S-\overset{\overset{O}{\|}}{C}-O-Y'$$

wherein Y is an alkyl radical of from 1 to 6 carbon atoms and Y' is an alkyl radical of from 1 to 3 carbon atoms and (B) a dialkyl thionocarbamate of the general formula $$Y-O-\overset{\overset{S}{\|}}{C}-NH-Y'$$

wherein Y and Y' are as defined above, said mixture consisting at least 5 percent by weight of phosphorodithioic compounds.

Presently useful phosphorodithioic compounds include the O,O-bis(alkylphenyl) phosphorodithioic acids:

$$-H-S-\underset{\underset{S}{\|}}{P}(OR)_2-$$

Some examples thereof are:

O,O-bis(2-,3-, or 4-ethylphenyl) phosphorodithioic acid

O,O-bis(2,3- or 2,4-dimethylphenyl) phosphorodithioic acid

O,O-bis(2,3,4- or 2,4,6-trimethylphenyl) phosphorodithioic acid

O,O-bis(4-isobutyl- or 4-hexylphenyl) phosphorodithioic acid

O-4-isopropylphenyl O-3-pentylphenyl phosphorodithioic acid

Presently useful alkali metal salts of the phosphorodithioic acids include the sodium, potassium, lithium or rubidium salts. They may be depicted by the general formula:

$$-Y-S-\underset{\underset{S}{\|}}{P}(OR)_2-$$

wherein Y is alkali metal. Examples of such salts are:

Sodium O,O-bis(4-sec-butylphenyl) phosphorodithioate

Lithium O,O-bis(3,4,5-trimethylphenyl) phosphorodithioate

Potassium O,O-bis(2,5-diethylphenyl) phosphorodithioate

Rubidium O-3-propylphenyl O-4-ethylphenyl phosphorodithioate

The ammonium salts, e.g., ammonium O,O-bis(2,4-diethylphenyl) phosphorodithioate, are also useful.

Of particular commercial interest are mixtures of isomeric compounds in which the same alkyl radical is present on different positions of the phenyl residue; for example, a mixture of sodium O,O-bis(4-isopropylphenyl) phosphorodithioate and sodium O,O-bis(3-isopropylphenyl) phosphorodithioate. The mixtures are readily obtained by using the crude isopropylphenol of commerce in preparing the phosphorodithioate. Such mixtures function very well in the present process and are much less expensive than the individual compounds. Mixtures of isomeric free acids or of free acids and alkali metal or ammonium salts are also useful and often convenient.

The useful collector of the presently provided flotation process is a mixture of one or more of the above defined phosphorothioic compounds and an alkyl xanthogen alkyl formate or a dialkyl thionocarbamate. Alternatively, the phosphorodithioic compound may be present in alkyl admixture with both the xanthogen alkyl formate and the dialkyl thionocarbamate. As examples of the alkyl xanthogen alkyl formates may be mentioned butyl xanthogen ethyl formate, hexyl xanthogen ethyl formate and methyl xanthogen ethyl formate. Examples of the dialkyl thionocarbamates are O-hexyl N-ethyl thionocarbamate, O-butyl N-methyl thionocarbamate, O-methyl N-ethyl thionocarbamate and O-isopropyl N-methyl thionocarbamate.

The above defined phosphorodithioic compounds, the alkyl xanthogen alkyl formates and the dialkyl thionocarbamates are characterized by some degree of collector efficiency when used alone. However, they are known to have disadvantages that usually outweigh their advantages. For example, the alkyl xanthogen alkyl formates have a high affinity for exceptionally fine particles of valuable minerals not readily collected by some better known collectors; however, owing to the nature of the generated froth, extremely coarse mineral particles or middling particles will not be readily supported in the froth, and a fraction of the metal values will thus be lost into the tailings. The dialkyl thionocarbamates, on the other hand, are sometimes useful with ores that cannot be worked with the xanthogen formates. For example, the thionocarbamates are particularly valuable for the flotation of ores in which chalcocite is the predominant copper mineral, whereas the alkyl xanthogen alkyl formates are more useful in the flotation of chalcopyrite. Both the dialkyl thionocarbamates and the alkyl xanthogen alkyl formates are water-insoluble oils. Hence, when adding them to the flotation circuit, extreme care must be taken to assure sufficient conditioning into the system; otherwise, the collector will float to the top of the slurry and hinder efficient froth removal.

Surprisingly, use of the phosphorodithioic compound with either the alkyl xanthogen alkyl formate or the dialkyl thionocarbamate or with both, alleviates many of the disadvantages previously encountered with collector use of these materials. In themselves, the phosphorodithioic compounds are very valuable in that they are highly selective against iron sulfides. When used with the alkyl xanthogen formates or the dialkyl thionocarbamates, this property continues to be evidenced. At the same time, the beneficial effects of the alkyl xanthogen alkyl formates or the dialkyl thionocarbamate compounds are demonstrated while their former disadvantage are suppressed. The mixtures show a synergistic effect; the resultant recovery of metals is greater than with a single constituent, alone. Some of the advantages which are realized by use of the mixtures are:

1. Excellent affinity for fine, valuable mineral particles.
2. Improved recovery of coarse and middling particles.
3. Reduced dosages in oxidized ore bodies where slime interference affects most xanthates and dithiophosphates.
4. High selectivity against iron sulfides.
5. The addition of the phosphorothioic compound to either the dialkyl thionocarbamate or the alkyl xanthogen alkyl formate or to both results in an end product which, although not water soluble, is readily emulsifiable, so that a diluted product is attainable so long as moderate continuous agitation is available to the storage facility. Therefore, larger and more accurately metered dosages are permitted, and adequate conditioning of the collector into the flotation pulp is attained.

Although the invention is very valuable for the concentration of copper from sulfidic ores, the presently provided flotation method is of general utility, including concentration of such metals as silver, gold and zinc from ores in which such metals may be present at only very low levels. The presently provided method is effective over a wide pH range, and can provide improved selectivity at substantial lime (CaO:pH modifier) savings in alkaline flotation circuits.

The invention is further illustrated by, but not limited to, the following examples:

EXAMPLE 1

This example shows testing of the following materials as collectors:

(1) O,O-bis(isopropylphenyl) phosphorodithioic acid
(2) Isobutyl xanthogen ethyl formate
(3) A mixture of (1) and (2) in the ratio shown below San Manuel copper ore (Magna Copper Company) was crushed, and a mixture consisting of 700 g of the crushed ore, 500 ml of water, 0.50 g of lime and 5 mg of the collector shown below was ground for 6 minutes in a laboratory ball mill. The resulting pulp was transferred to a laboratory flotation cell, and 30 mg of methylisobutylcarbinol as frother was added. Flotation was conducted for 4 minutes. Assay of the resulting concentrate gave the following results:

| Collector | Copper, % recovery |
|---|---|
| (1) | 83.3 |
| (2) | 84.2 |
| Mixture of (1) and (2) in 38-62% wt. ratio | 85.5 |

EXAMPLE 2

This example is like Example 1, except that the copper ore which was used was Twin Buttes (Anamax Mining Company), that there was used 1.25 g of lime, 10 mg of collector, 15 mg of frother, and a grinding time of 8 minutes. Assay of the resulting concentrate gave the following results:

| Collector | Copper, % Recovery |
|---|---|
| (A) Sodium O,O—bis (4-isopropylphenyl) phosphorodithioate | 80.9 |
| (B) n-butyl xanthogen ethyl formate | 81.2 |
| (C) Mixture of (A) and (B) in a 35:65% wt. ratio | 88 |

EXAMPLE 3

Operating substantially as in Example 1, 1000 g of crushed copper ore (Superior, Magma Copper Company) was ground for 8 minutes in the laboratory ball mill with 600 ml of water, 0.60 g of lime, and 15 mg of the collector shown below. The pulp was then transferred to a flotation cell, 25 mg of methylisobutylcarbinol frother was added, and flotation was conducted over a 4 minute period. Assay of the resulting concentrate gave the following results:

| Collector | Copper, % Recovery |
|---|---|
| (A) Sodium O,O—bis(4-isopropylphenyl) phosphorodithioate | 92.6 |
| (B) N—Ethyl O—isopropyl thionocarbamate | 93.6 |
| (C) Mixture of (A) and (B) in a 35:65% wt. ratio | 94.6 |

EXAMPLE 4

The following materials were evaluated for collector efficacy:

(I) Sodium O,O-bis(4-isopropylphenyl) phosphorodithioate (II) N-Ethyl O-isopropyl thionocarbamate (III) Isobutyl xanthogen ethyl formate (IV) A mixture consisting of a 5:20:75 percent weight ratio of (I), (II) and (III), respectively.

700 g of crushed Cuajone (Southern Peru Copper Company) copper ore, 0.50 g of lime, 500 mg water, and 10 mg of collector were ground together for 6 minutes in the ball mill, and then transferred to a flotation cell. After adding 35 mg. of methylisobutylcarbinol frother, the whole was floated for 4 minutes. Assay of the resulting concentrate gave the following results:

| Collector | Copper, % Recovery |
|---|---|
| (I) | 81.5 |
| (II) | 84.3 |
| (III) | 81.6 |
| (IV) | 85.5 |

Mixtures of the presently useful O,O-bis(alkylphenyl) phosphorodithioic compounds with the alkyl xanthogen alkyl formates and/or the thionocarbamates are generally useful in ore dressing, but they are especially valuable in their selectivity. They tend to favor collection of copper, lead, zinc and molybdenum sulfides and the precious metals, while collecting less of the usually undesirable iron sulfide. The presently provided mixtures possess high selectivity against pyrite and pyrrhotite. They possess exceptional utility in the flotation of sulfide copper and copper activated zinc sulfide from alkaline pulps. In many cases where slime or talc interference is a problem, the herein described phosphorodithioate, alkyl xanthogen alkyl formate and/or dialkyl thionocarbamate mixtures will produce higher concentrate grades and recoveries. In the flotation of precious metals such as gold and silver, the presently provided collectors have been found to possess significant affinity.

The herein described flotation procedures are given by way of illustration only, since any ore dressing flotation technique may be used so long as the presently provided collector is employed. It is customary in the art to employ other additives or reagents in flotation; for example, there may also be used materials which serve as frothers, activators, depressants or modifying agents. The presence or absence of such reagents and their nature will vary with ores and reaction conditions, and selection of such other additives for serving differing functions can be readily arrived at by easy experimentation.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method of beneficiating copper from copper-bearing ores by froth flotation wherein there is employed a collector comprising a mixture of (I) a phosphorodithio compound of the formula:

$$X-S-\underset{\underset{S}{\|}}{P}(OR)_2$$

in a concentration in the range of about 5 to 38% wherein X is selected from the class consisting of alkali metal and the ammonium radical and R is an alkyl substituted phenyl radical having a total of from 8 to 14 carbon atoms, from 1 to 3 alkyl substituents, and from 2 to 6 carbon atoms in each alkyl substituent, and (II) a thiono compound comprising at least one of (A) alkyl xanthogen alkyl formates of the general formula:

$$Y-O-\overset{\overset{S}{\|}}{C}-S-\overset{\overset{O}{\|}}{C}-O-Y'$$

in a concentration in the range of about 62 to 75% by weight, wherein Y is an alkyl radical having 1 to 6 carbon atoms and Y' is an alkyl radical selected from the class consisting of methyl and ethyl; and (B) a dialkyl thionocarbamate of the general formula:

$$Z-O-\overset{\overset{S}{\|}}{C}-HN-Z'$$

in a concentration in the range of about 20 to 65% by weight, wherein Z is an alkyl radical having 1 to 6 carbon atoms and Z' is an alkyl radical selected from the class consisting of methyl and ethyl wherein the froth flotation is conducted in an alkaline circuit with recovery of copper from the froth.

2. The ore dressing method defined in claim 1, further limited in that X is alkali metal.

3. The ore dressing method defined in claim 1, further limited in that I is O,O-bis(isopropylphenyl) phosphorodithioic alkali salt.

4. The ore dressing method defined in claim 1, further limited in that said alkyl xanthogen alkyl formate is isobutyl xanthogen ethyl formate.

5. The ore dressing method defined in claim 1, further limited in that said dialkyl thionocarbamate is N-ethyl O-isopropyl thionocarbamate.

6. The ore dressing method defined in claim 1, further limited in that the collector is a mixture of sodium O,O-bis(4-isopropylphenyl) phosphorodithioate and N-ethyl O-isopropyl thionocarbamate.

7. A collector for recovering copper metal values from copper bearing ore by froth flotation in an alkaline circuit, comprising a mixture of (I) a phosphorodithio compound of the formula:

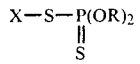

in a concentraion in the range of about 5 to 38% by weight, wherein X is selected from the class consisting of alkali metal and the ammonium radical and R is an alkyl substituted phenyl radical having a total of from 8 to 14 carbon atoms, from 1 to 3 alkyl substituents, and from 1 to 6 carbon atoms in each alkyl substituent, and (II) a thiono compound comprising at least one of (A) alkyl xanthogen alkyl formates of the general formula:

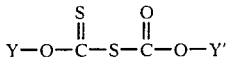

in a concentration in the range of about 62 to 75% by weight, wherein Y is an alkyl radical having 1 to 6 carbon atoms and Y′ is an alkyl radical selected vfrom the class consisting of methyl and ethyl; and (B) a dialkyl thionocarbamate of the general formula:

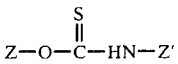

in a concentration in the range of about 20 to 65% by weight, wherein Z is an alkyl radical having 1 to 6 carbon atoms and Z′ is an alkyl radical having 1 to 2 carbon atoms.

8. The collector mixture of claim 7, wherein said phosphorodithioic compound is the alkali salt.

9. The collector of claim 7, wherein said thiono compound is an alkyl xanthogen alkyl formate.

10. The collector of claim 7, wherein said thiono compound is a dialkyl thionocarbamate.

11. The collector of claim 7, wherein said phosphorodithio compound is O,O-bis(isopropylphenyl) phosphorodithioic alkali salt.

12. The collector of claim 7, wherein said thiono compound is isobutyl xanthogen ethyl formate.

13. The collector of claim 7, wherein said thiono compound is N-ethyl O-isopropyl thionocarbamate.

14. The collector of claim 7, wherein said phosphorodithio compound is sodium O,O-bis(4-isopropylphenyl) phosphorodithioate and said thiono compound is N-ethyl O-isopropyl thionocarbamate.

15. The collector compound of claim 7, wherein said phosphorodithio compound is the free acid, and said thiono compound is an alkyl xanthogen alkyl formate.

16. The collector compound of claim 7, wherein said phosphorodithio compound is the free acid, and said thiono compound is a dialkyl thionocarbamate.

17. The collector compound of claim 7, wherein said phosphorodithio compound is an alkali salt, and said thiono compound is an alkyl xanthogen alkyl formate.

18. The collector compound of claim 7, wherein said phosphorodithio compound is an alkali salt, and said thiono compound is a dialkyl thionocarbamate.

19. The collector compound of claim 7, wherein said collector comprises a mixture of said phosphorodithio compound, said alkyl xanthogen alkyl formate and said dialkyl thionocarbamate.

20. The collector compound of claim 7, wherein said phosphorodithio compound is an alkali salt.

* * * * *